US007947889B2

(12) United States Patent
Usa et al.

(10) Patent No.: US 7,947,889 B2
(45) Date of Patent: May 24, 2011

(54) ENSEMBLE SYSTEM

(75) Inventors: Satoshi Usa, Hamamatsu (JP); Tomomitsu Urai, Hamamatsu (JP)

(73) Assignee: Yamaha Corporation (JP)

( * ) Notice: Subject to any disclaimer, the term of this patent is extended or adjusted under 35 U.S.C. 154(b) by 237 days.

(21) Appl. No.: 12/088,306

(22) PCT Filed: Jul. 24, 2006

(86) PCT No.: PCT/JP2006/315077

§ 371 (c)(1), (2), (4) Date: Mar. 27, 2008

(87) PCT Pub. No.: WO2007/037068

PCT Pub. Date: Apr. 5, 2007

(65) Prior Publication Data

US 2009/0145285 A1 Jun. 11, 2009

(30) Foreign Application Priority Data

Sep. 28, 2005 (JP) ..... 2005-281060

(51) Int. Cl.
*G10H 1/00* (2006.01)

(52) U.S. Cl. ..... 84/615; 84/653; 84/645

(58) Field of Classification Search ..... 84/600–602, 84/615, 653, 645
See application file for complete search history.

(56) References Cited

U.S. PATENT DOCUMENTS 3,808,936 A 5/1974 Shrader
3,823,637 A 7/1974 Scott
3,895,555 A 7/1975 Peterson et al.
3,919,913 A 11/1975 Shrader
4,364,299 A 12/1982 Nakada et al.
4,694,723 A 9/1987 Shinohara et al.
4,781,099 A 11/1988 Koike
5,002,491 A 3/1991 Abrahamson et al.
5,728,960 A * 3/1998 Sitrick ..... 84/477 R
5,952,597 A 9/1999 Weinstock et al.
5,980,261 A 11/1999 Mino et al.
6,084,168 A * 7/2000 Sitrick ..... 84/477 R
6,198,034 B1 * 3/2001 Beach et al. ..... 84/600
6,211,451 B1 * 4/2001 Tohgi et al. ..... 84/470 R
(Continued)

FOREIGN PATENT DOCUMENTS

EP 0 933 906 A2 8/1999
(Continued)

OTHER PUBLICATIONS

International search report issued in corresponding PCT/JP2006/315077, dated Oct. 31, 2006.

(Continued)

*Primary Examiner* — David S. Warren
(74) *Attorney, Agent, or Firm* — Rossi, Kimms & McDowell LLP

(57) ABSTRACT

An ensemble system enabling easy, flexible assignment of performance parts to the facilitator and the performers. In "setting" field, performance terminals (facilitator and piano (1 to 5)) are displayed. A pull-down menu for selecting presence/absence of each performance terminal and radio buttons for assigning performance parts are displayed. According to the presence/absence of each student, the selection of a presence/absence menu is inputted. When song title data is selected, a controller (1) reads a part assignment table of the song data and assigns a performance part to each performance terminal for which presence is selected. A performance part can be manually assigned to each performance terminal.

6 Claims, 13 Drawing Sheets

U.S. PATENT DOCUMENTS

| | | | | |
|---|---|---|---|---|
| 6,348,648 | B1 * | 2/2002 | Connick, Jr. | 84/477 R |
| 6,417,435 | B2 | 7/2002 | Chantzis et al. | |
| 6,438,611 | B1 | 8/2002 | Hara et al. | |
| 6,441,289 | B1 | 8/2002 | Shinsky | |
| 6,448,486 | B1 | 9/2002 | Shinsky | |
| 6,495,747 | B2 | 12/2002 | Shimaya et al. | |
| 6,504,090 | B2 | 1/2003 | Tsai et al. | |
| 6,660,922 | B1 | 12/2003 | Roeder | |
| 6,751,439 | B2 * | 6/2004 | Tice et al. | 434/350 |
| 6,921,856 | B2 * | 7/2005 | Koseki | 84/603 |
| 6,995,311 | B2 | 2/2006 | Stevenson | |
| 7,074,999 | B2 * | 7/2006 | Sitrick et al. | 84/477 R |
| 7,098,392 | B2 * | 8/2006 | Sitrick et al. | 84/477 R |
| 7,157,638 | B1 * | 1/2007 | Sitrick | 84/477 R |
| 7,189,910 | B2 | 3/2007 | Hasegawa | |
| 7,297,856 | B2 * | 11/2007 | Sitrick | 84/477 R |
| 7,335,833 | B2 | 2/2008 | Smith et al. | |
| 7,423,213 | B2 * | 9/2008 | Sitrick | 84/477 R |
| 7,612,278 | B2 * | 11/2009 | Sitrick et al. | 84/609 |
| 2001/0007960 | A1 | 7/2001 | Yoshihara et al. | |
| 2001/0032539 | A1 | 10/2001 | Chantzis et al. | |
| 2002/0035916 | A1 | 3/2002 | Tsai et al. | |
| 2002/0144586 | A1 * | 10/2002 | Connick, Jr. | 84/478 |
| 2002/0157521 | A1 | 10/2002 | Shahal | |
| 2002/0165921 | A1 | 11/2002 | Sapieyevski | |
| 2003/0000368 | A1 | 1/2003 | Isozaki | |
| 2003/0024375 | A1 * | 2/2003 | Sitrick | 84/477 R |
| 2003/0100965 | A1 * | 5/2003 | Sitrick et al. | 700/83 |
| 2003/0110925 | A1 * | 6/2003 | Sitrick et al. | 84/477 R |
| 2003/0110926 | A1 * | 6/2003 | Sitrick et al. | 84/477 R |
| 2003/0150317 | A1 | 8/2003 | Hamilton | |
| 2003/0167904 | A1 | 9/2003 | Itoh | |
| 2003/0167906 | A1 | 9/2003 | Isozaki | |
| 2003/0177886 | A1 | 9/2003 | Koseki | |
| 2003/0182133 | A1 | 9/2003 | Kawashima et al. | |
| 2003/0188626 | A1 | 10/2003 | Kriechbaum et al. | |
| 2004/0055443 | A1 | 3/2004 | Nishitani et al. | |
| 2004/0112202 | A1 * | 6/2004 | Smith et al. | 84/609 |
| 2004/0187673 | A1 | 9/2004 | Stevenson | |
| 2004/0221708 | A1 | 11/2004 | Hasegawa | |
| 2004/0237756 | A1 | 12/2004 | Forbes | |
| 2005/0005761 | A1 | 1/2005 | Knudsen | |
| 2005/0120865 | A1 * | 6/2005 | Tada | 84/600 |
| 2005/0172790 | A1 | 8/2005 | Tada | |
| 2005/0262989 | A1 | 12/2005 | Franzblau | |
| 2006/0117935 | A1 * | 6/2006 | Sitrick | 84/477 R |
| 2006/0213358 | A1 | 9/2006 | Motsenbocker | |
| 2006/0288842 | A1 * | 12/2006 | Sitrick et al. | 84/477 R |
| 2007/0089590 | A1 | 4/2007 | Katou | |
| 2008/0041217 | A1 | 2/2008 | Knudsen | |
| 2008/0060499 | A1 * | 3/2008 | Sitrick | 84/477 R |
| 2008/0065983 | A1 * | 3/2008 | Sitrick | 715/273 |
| 2008/0072156 | A1 * | 3/2008 | Sitrick | 715/733 |
| 2008/0134861 | A1 | 6/2008 | Pearson | |
| 2009/0044685 | A1 | 2/2009 | Usa et al. | |

FOREIGN PATENT DOCUMENTS

| | | | |
|---|---|---|---|
| EP | 1 553 556 | A1 | 7/2005 |
| EP | 1 562 175 | A1 | 8/2005 |
| EP | 1 926 080 | A1 | 5/2008 |
| JP | 07-261757 | A | 10/1995 |
| JP | 8-16160 | A | 1/1996 |
| JP | 2000-276141 | A | 10/2000 |
| JP | 2001-337675 | A | 12/2001 |
| JP | 2002-91290 | A | 3/2002 |
| JP | 2002-132137 | A | 5/2002 |
| JP | 2003-84760 | A | 3/2003 |
| JP | 2003-288077 | A | 10/2003 |
| JP | 2004-093613 | A | 3/2004 |
| JP | 2004-184757 | A | 7/2004 |
| JP | 2005-62697 | A | 3/2005 |
| JP | 2005-165078 | A | 6/2005 |
| JP | 2005-250053 | A | 9/2005 |
| KR | 1996-0702658 | A | 4/1996 |
| KR | 10-2001-0109498 | A | 12/2001 |
| KR | 10-2003-0076405 | A | 9/2003 |
| WO | 94/28539 | A2 | 12/1994 |
| WO | 01/93261 | A1 | 12/2001 |

OTHER PUBLICATIONS

English translation of the International Preliminary Report issued in corresponding PCT/JP2006/315077, dated Apr. 10, 2008.

English translation of the International Preliminary Report corresponding to related co-pending U.S. Appl. No. 12/088,430, dated Apr. 10, 2008.

Korean Office Action for Application No. 10-2008-7008627, "Ensemble System", Jul. 30, 2009. (Partial Translation) (Cited in U.S. Appl. No. 12/088,430).

Korean Office Action for Application No. 10-2008-7007402, "Ensemble System", Jul. 29, 2009. (Partial Translation) (Cited in U.S. Appl. No. 12/066,519).

International Search Report issued in PCT/JP2006/315070, which corresponds to related co-pending U.S. Appl. No. 12/066,519.

Specification and drawings of un-published related co-pending U.S. Appl. No. 12/066,519, filed Mar. 12, 2008. "Ensemble System"; Satoshi Usa et al.

International Search Report issued in PCT/JP2006/315075, dated Oct. 31, 2006, which corresponds to related co-pending U.S. Appl. No. 12/088,430.

Specification and drawings of un-published related co-pending U.S. Appl. No. 12/088,430, filed Mar. 27, 2008. "Ensemble System"; Satoshi Usa et al.

English translation of the International Preliminary Report issued in application No. PCT/JP2006/315070 relating to co-pending U.S. Appl. No. 12/066,519, mailed Mar. 27, 2088.

Extended European Search Report issued in corresponding European Patent Application No. 06768386.2 dated Jul. 2, 2010.

Extended European Search Report issued in corresponding European Patent Application No. 06768384.7 dated Jul. 13, 2010, which corresponds to related co-pending U.S. Appl. No. 12/088,430.

Extended European Search Report issued in corresponding European Patent Application No. 06768379.7 dated Jun. 25, 2010, which corresponds to related co-pending U.S. Appl. No. 12/066,519.

Notification of Reasons for Rejection dated Jan. 18, 2011 issued in corresponding Japanese Patent Application No. 2005-281060, foreign version of the Office Action was previously filed in an IDS on Feb. 2, 2011, only the full English translation is submitted herewith.

Notification of Reasons for Rejection dated Jan. 18, 2011 issued in corresponding Japanese Patent Application No. 2005-281060.

* cited by examiner

FIG. 4

MUSIC DATA
(FOR ONE MUSIC PIECE)

| |
|---|
| PART ID 1<br>(PART IDENTIFICATION INFORMATION) |
| MUSIC DATA<br>(PERFORMANCE INFORMATION) |
| PART ID 2<br>(PART IDENTIFICATION INFORMATION) |
| MUSIC DATA<br>(PERFORMANCE INFORMATION) |
| ⋮ |

FIG. 5

PART ASSIGNMENT TABLE

| PART ID | MIDI PORT |
|---|---|
| 1 | 0 (FACILITATOR) |
| 2 | 1 (PIANO 1) |
| 3 | 2 (PIANO 2) |
| 4 | 3 (PIANO 3) |
| 5 | 4 (PIANO 4) |
| 6 | 5 (PIANO 5) |

Piano1
Piano2
Piano3
Piano4
Piano5

ENSEMBLE SYSTEM

This application is a U.S. National Phase Application of PCT International Application PCT/JP2006/315077 filed on Jul. 24, 2006 which is based on and claims priority from JP 2005-281060 filed on Sep. 28, 2005. The contents of these applications in their entirety are incorporated herein by reference.

TECHNICAL FIELD

The present invention relates to an ensemble system that enables even a performer unfamiliar with operation of musical instrument to easily participate in an ensemble performance, and more particularly, to an ensemble system with which performance parts can easily and flexibly be assigned to a facilitator and participants.

BACKGROUND ART

Conventionally, there is known an electronic musical instrument for generating music sounds according to performer's operation. In general, such an instrument is modeled on, e.g., piano, and designed to be operated similarly to a natural piano instrument. Therefore, some level of skill is needed to play the instrument and a long time is required to acquire proficiency in playing it.

In recent years, however, there is a demand that a performer unfamiliar with operating a musical instrument should be permitted to play pieces of music. Also, there is a demand that not only a performer can enjoy playing music, but also many performers can participate in and achieve an ensemble performance.

To this end, there has been proposed in, for example, Japanese Laid-open Patent Publication No. 2000-276141, an electronic musical instrument enabling a plurality of users unfamiliar with playing a musical instrument to participate in playing music.

With this electronic musical instrument, users are enabled to implement an ensemble performance by making some easy actions (such as waving their hands). With this instrument, performance information for one piece of music is transmitted in advance to slave units (operator units) connected to a base unit, and performance parts are respectively assigned by the base unit to the slave units in accordance with assignment instruction data recorded in a floppy disk. After the performance information being transmitted from the base unit to the slave units, the performance parts transmitted can each be played by only the slave unit associated therewith.

Each slave unit user plays a performance in time with a demonstrative performance by the base unit. On the other hand, in a case where a plurality of users (participants) perform rehabilitation or other activity together, they are often divided into groups each consisting of a predetermined number of performers (about five performers, for example) including a facilitator (guide) who guides other participants. With the above described electronic musical instrument, a performance cannot be played in time with an exemplary human performance and an exemplary performance cannot be performed by the facilitator.

An object of the present invention is to provide an ensemble system with which performance parts can easily and flexibly be assigned between a facilitator and participants.

DISCLOSURE OF THE INVENTION

To achieve the above object, an ensemble system of this invention comprises a plurality of performance terminals each having at least one performance operator unit used for performance operation, at least one tone generator, and a controller connected to the plurality of performance terminals and the at least one tone generator and adapted to control each of the performance terminals, wherein the controller includes storage means adapted to store pieces of music data for performance each including a plurality of performance parts, and an assignment list including identification information indicating which performance part should be assigned to which performance terminal, operation means used for designating at least one performance terminal participating in an ensemble and at least one performance terminal not participating in the ensemble, and used for selecting music data for performance to be played in the ensemble, performance part assignment means adapted to assign performance parts to respective performance terminals in accordance with the assignment list when music data for performance is selected by the operation means, the performance part assignment means being adapted to change assignment of at least one performance part from the performance terminal not participating in the ensemble to the performance terminal participating in the ensemble, and performance control means adapted to read out the performance part assigned to each of the performance terminals in accordance with a way in which the performance operator unit of each of the performance terminals is operated, and output data representing the read-out performance part to the tone generator.

In this invention, at least one performance terminal participating in an ensemble and at least one performance terminal not participating in the ensemble are selected by a user using the operation means of the controller, and music data for performance to be played in the ensemble is also selected. The music data for performance includes a plurality of performance parts. Identification information indicating which performance part should be assigned to which performance terminal is included in a list. When music data for performance is selected by the user, the controller reads out the list, and assigns performance parts to performance terminals participating in the ensemble. Subsequently, the user instructs the start of a performance, and carries out a performance operation using the performance operator unit of the performance terminal. The performance operator unit of the performance terminal is comprised of a keyboard of an electronic piano, for example. When a key of any of keyboards is depressed, an operation signal is transmitted to the controller. Based on the received operation signal, the controller transmits a sounding instruction for the performance part assigned to the performance terminal concerned to the tone generator. In response to the sounding instruction, the tone generator sounds music sound.

Preferably, the controller includes mode changeover means adapted to change an ordinary performance mode over to a model performance mode, and selection means adapted to select, in the model performance mode, at least one performance terminal for execution of a model performance from among the plurality of performance terminals, a performance operation on the performance terminal selected by the selection means is carried out at a guiding performance terminal, and music sound is reproduced by the selected performance terminal in accordance with the performance operation at the guiding performance terminal.

With this preferred embodiment, a model performance by a facilitator (guide) can be heard by each user by his/her performance terminal at hand.

Preferably, the tone generator is built in each of the plurality of performance terminals, and the performance control means of the controller is adapted to output data on the read-out performance part to the tone generator built in the performance terminal to which that performance part is assigned.

With the above preferred embodiment, based on the operation signal received from one performance terminal, the controller reads out the performance part assigned to the one performance terminal and transmits data on the read-out performance part to the tone generator built in that performance terminal. Music sound is sounded by the built-in tone generator of the one performance terminal in accordance with a received sounding instruction. As a result, respective performance parts are sounded by the corresponding performance terminals.

Preferably, the performance part assignment means is adapted to change performance part assignment to each of the performance terminals in accordance with a performance part assignment changing instruction from the operation means.

With this preferred embodiment, the performance part for each performance terminal can manually be changed by a user. As a result, performance parts can freely be played by performance terminals different from those at the initial setting.

Preferably, the performance part assignment means is adapted, in a case where performance terminals indicated in the assignment list include a performance terminal not participating in the ensemble, to assign a guiding performance terminal the performance part having been assigned to the performance terminal not participating in the ensemble.

With this preferred embodiment, more than one performance parts are assigned to the performance terminal for facilitator.

Preferably, the storage means is adapted to further store a table in which interrelated performance parts are designated as one group, and the performance part assignment means is adapted, in a case where the performance terminals indicated in the assignment list include a performance terminal not participating in the ensemble, to refer to the table and assign a performance part having been assigned to the performance terminal not participating in the ensemble to a performance terminal to which another performance part belonging to a same group has been assigned.

With this preferred embodiment, the table is referred to and a performance part (for example, drums) having been assigned to a performance terminal not participating in an ensemble is assigned to a performance terminal to which another performance part (for example, base) belonging to the same group has been assigned. As a result, the assignment of performance part can be changed from the non-participating performance to another performance terminal to which a performance part close in tone color or role has been assigned. Interrelated performance parts are not only a combination of a drums part and a base part, but also any combination of performance parts for string instruments, wind instruments, etc.

BRIEF DESCRIPTION OF DRAWINGS

FIG. 4 is a view showing an example of music data;

FIG. 5 is a view showing an example of a part assignment table;

BEST MODE FOR CARRYING OUT THE INVENTION

In the following, an embodiment of this invention will be described in detail with reference to the drawings.

Figure 1:
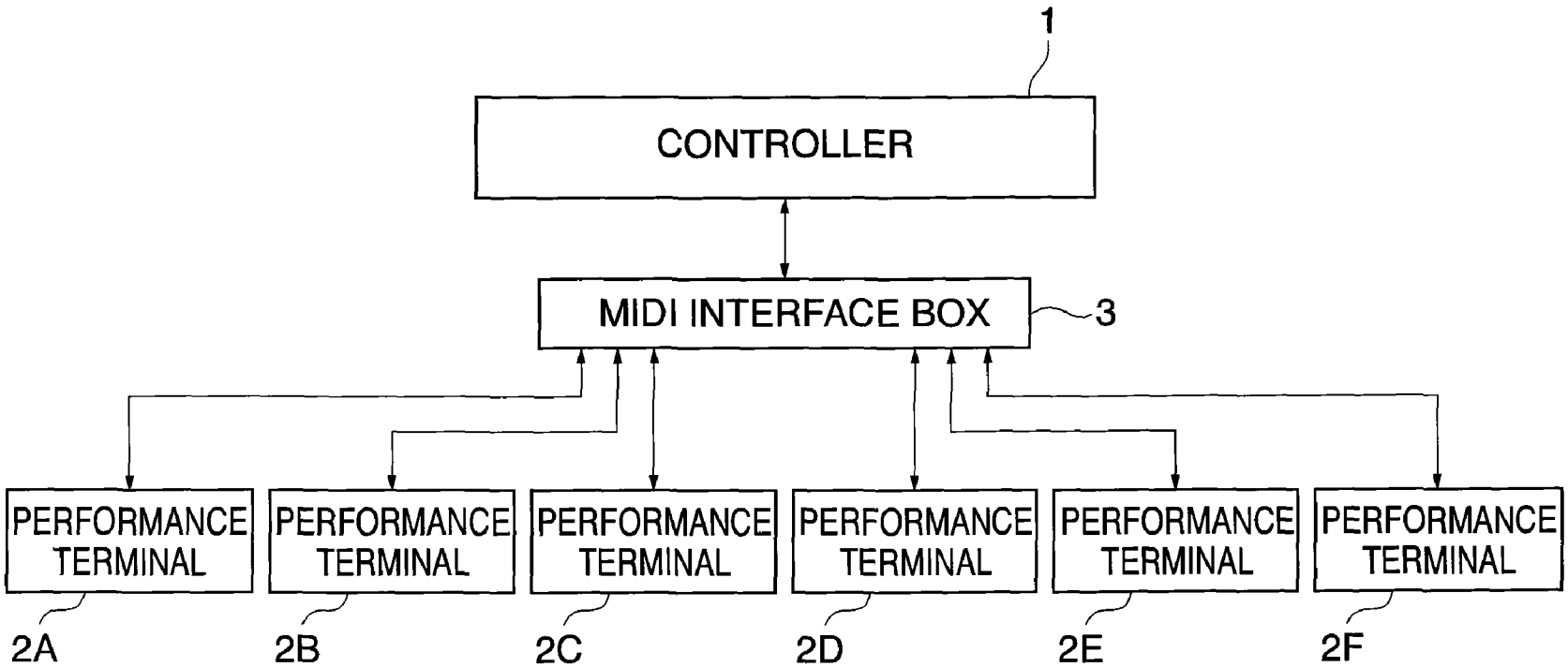
FIG. 1 is a block diagram showing the construction of a performance system.

FIG. 1 is a block diagram showing the construction of an ensemble system. As shown in FIG. 1, the ensemble system includes a controller 1 and a plurality of (six in FIG. 1) performance terminals 2A to 2F connected to the controller 1 via a MIDI interface box 3. Among the performance terminals 2, the performance terminal 2A is for use by a facilitator (guide), and the performance terminals 2B to 2F are for use by participants (educands). Five participants using the performance terminals 2B to 2F always use the same performance terminals 2, whereby the facilitator can identify the participants based on the performance terminals used by them.

The controller 1 is implemented by, for example, a personal computer, and controls the performance terminals 2 and collects data using software installed thereon. The controller 1 stores pieces of music data for performance each consisting of a plurality of performance parts. These parts include one or more melody parts, rhythm parts, accompaniment parts, and so on. The controller 1 includes a communication unit 11, described below, for transmitting sounding data for a part (or parts) to a corresponding one or ones of the performance terminals 2.

The performance terminals 2 are used by users to implement performance operations, and generate music sounds in accordance with users' performance operations. Each of the performance terminals is constituted by, for example, an electronic piano or some other electronic keyboard instrument. In this embodiment, using the MIDI interface box 3 USB-connected to the controller 1, the performance terminals 2 are connected via separate MIDI systems. In FIG. 1, the performance terminal 2A is for use by the facilitator, and the performance terminal for the facilitator is designated by the controller 1. The performance terminals 2 are not limited to electronic pianos but may be other forms of electronic musical instruments such as electronic guitars, and in appearance, these terminals may not, of course, be limited to natural musical instruments but may be terminals each simply having an operator unit such as button.

It should be noted that the performance terminals 2 are not limited to those each having a tone generator incorporated therein. Alternatively, one or more independent tone generators can be connected to the controller 1. In that case, a single or as many tone generators as the performance terminals 2 may be connected to the controller 1. If as many tone generators as the performance terminals 2 are connected, these tone generators are respectively assigned to the performance terminals 2, and parts of music data for performance are assigned by the controller 1.

In the ensemble system, performance parts of music data for performance stored in the controller 1 are respectively assigned to the performance terminals 2, and each performance terminal 2 carries out an automatic performance of the performance part uniquely assigned thereto. When a performance operation (for example, key depression on the electronic piano) is performed by any of users of the performance terminals 2, instructions on tempo and timing are transmitted to the controller 1. Based on the input instructions on tempo and timing, a sounding instruction to sound notes of the performance part assigned to the performance terminal 2 is transmitted from the controller 1 to the performance terminal 2. An automatic performance is performed by the performance terminal 2 based on the sounding instruction received. Educands who are using the performance terminals 2 adjust tempos such as to match the tempo of the facilitator, whereby an ensemble performance is realized. The following is a detailed description of the constructions of the controller 1 and the performance terminal 2.

Figure 2:
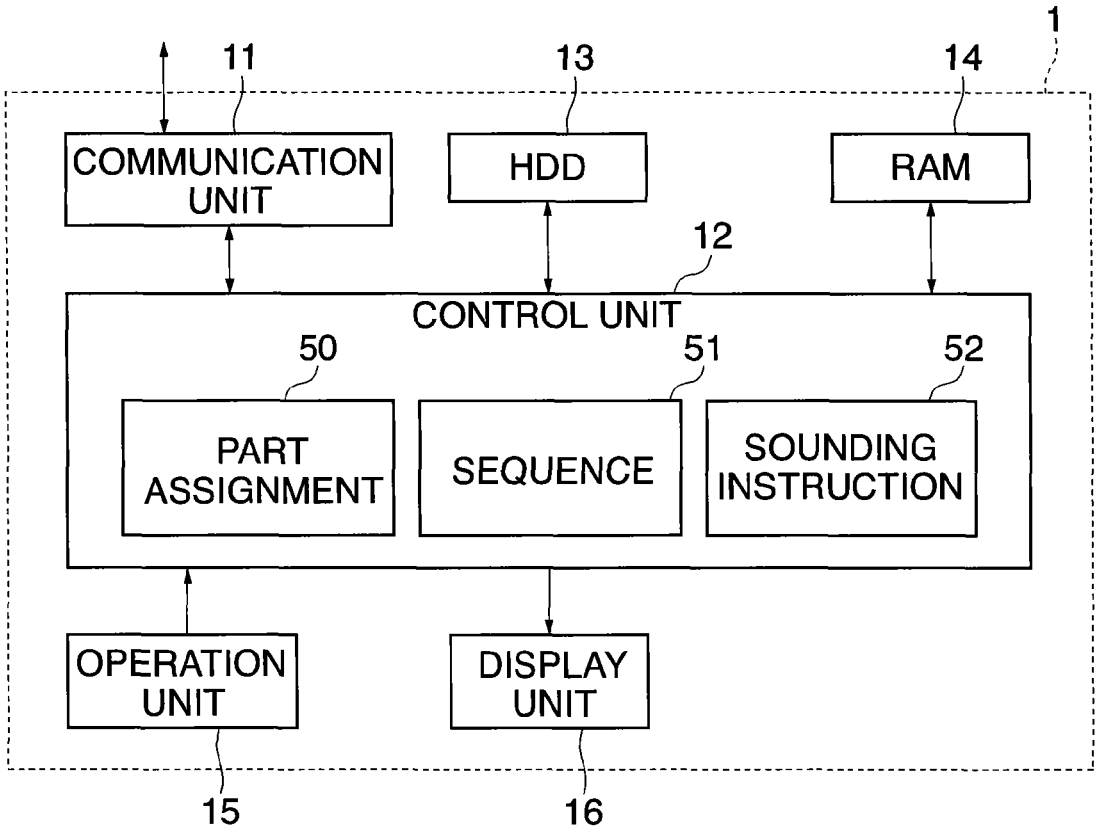
FIG. 2 is a block diagram showing the construction of a controller.

FIG. 2 is a block diagram showing the construction of the controller 1. As shown in FIG. 2, the controller 1 includes a communication unit 11, a control unit 12, an HDD 13, a RAM 14, an operation unit 15, and a display unit 16. The communication unit 11, HDD 13, RAM 14, operation unit 15, and display unit 16 are connected to the control unit 12.

The communication unit 11 is a circuit unit that communicates with the performance terminals 2, and has a USB interface (not shown). The MIDI interface box 3 is connected to the USB interface. The communication unit 11 communicates with the six performance terminals 2 via the MIDI interface box 3 and MIDI cables. The HDD 13 stores an operating program for the controller 1 and music data for performance consisting of a plurality of parts.

The control unit 12 reads out the operating program stored in the HDD 13, develops it in the RAM 14 as a work memory, and executes apart assignment process 50, a sequence process 51, a sounding instruction process 52, etc. In the part assignment process 50, the control unit 12 assigns the performance parts of music data for performance to respective ones of the performance terminals 2. In the sequence process 51, the control unit 12 sequences each performance part of the music data for performance (determines the pitch, length, etc. of each sound) according to the instructions on tempo and timing received from the corresponding performance terminal 2. In the sounding instruction process 52, the control unit 12 transmits, as sounding instruction data, the pitch, length, etc. of each sound determined in the sequence process 51 to the corresponding performance terminal 2.

The operation unit 15 is used by some user (mainly by the facilitator) to give instructions on operations of the present performance system. The facilitator operates the operation unit 15, whereby music data for performance is designated, and performance parts for respective performance terminals 2 are assigned, and so on. The display unit 16 includes a display (monitor). The facilitator and the participants conduct performance operations while watching the display unit 16 on which various information for an ensemble performance are displayed, as will be described in detail below.

Figure 3:
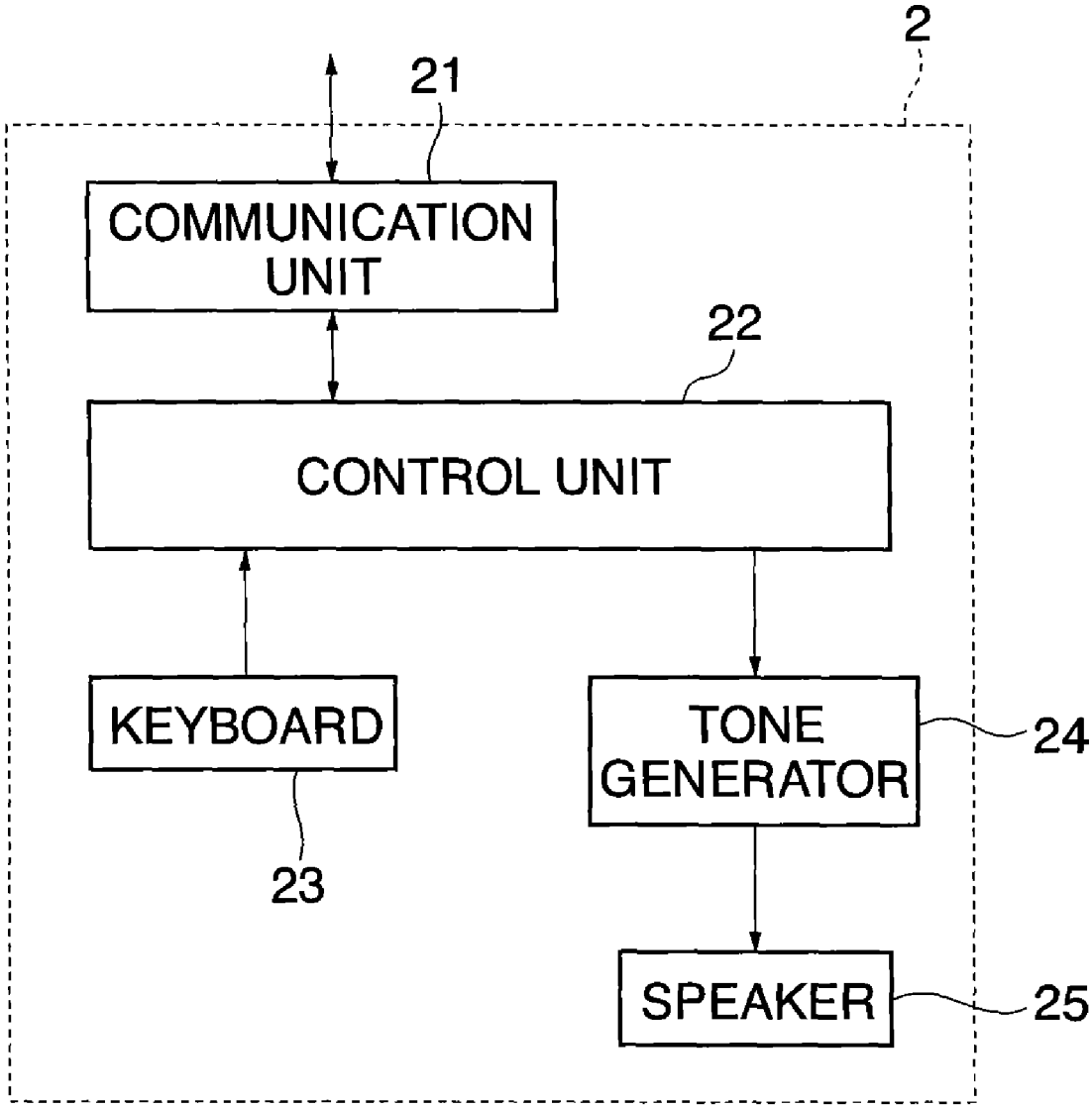
FIG. 3 is a block diagram showing the construction of a performance terminal.

FIG. 3 is a block diagram showing the construction of the performance terminal 2. As shown in FIG. 3, the performance terminal 2 includes a communication unit 21, a control unit 22, a keyboard 23 as a performance operator unit, a tone generator 24, and a speaker 25. The communication unit 21, keyboard 23, and tone generator 24 are connected to the control unit 22. The speaker 25 is connected to the tone generator 24.

The communication unit 21 is a MIDI interface and communicates with the controller 1 via a MIDI cable. The control unit 22 centrally controls the performance terminals 2. The keyboard 23 has, for example, 61 or 88 keys and can play in 5 to 7 octaves. The present ensemble system only uses data about Note On/Note Off messages and key depression intensity (Velocity), without distinction between keys. To this end, each key includes a sensor for detecting on/off and a sensor for detecting the intensity of key depression. The keyboard 23 outputs an operation signal to the controller 22 according to a key operation state (e.g., which key is depressed at what intensity). The control unit 22 transmits a Note On or Note Off message to the controller 1 via the communication unit 21 based on the input operation signal. The tone generator 24 generates a sound waveform under the control of the control unit 22 and outputs it as an audio signal to the speaker 25. The speaker 25 reproduces the audio signal input from the tone generator 24 to produce music sound. As described above, the tone generator 24 and the speaker 25 may not be incorporated in the performance terminal 2. The tone generator 24 and the speaker 25 may be connected to the controller 1 so that music sounds are sounded from a place different from where the performance terminal 2 is located. While as many tone generators as the performance terminals 2 may be connected to the controller 1, a single tone generator may be used.

In the above-described operation, when a key of the keyboard 23 is depressed, the control unit 22 transmits a Note On/Note Off message to the controller 1 (Local Off) and produces music sound according to an instruction from the controller 1 rather than according to a note message from the keyboard 23. Aside from the above described operations, the performance terminal 2 may of course be used as a general electronic musical instrument. When a key of the keyboard 23 is depressed, the control unit 22 may not transmit a note message to the controller 1 (Local On), but instruct the tone generator 24 to produce music sound based on the note message. Switching between Local On and Local Off may be performed by the user using the operation unit 15 of the controller 1 or using a terminal operation unit (not shown) on the performance terminal 2. It is also possible to set only some keyboards to Local Off and the other keyboards to Local On.

The following is an explanation of operations for implementing an ensemble performance using the above described ensemble system. Some user (in particular, the facilitator) selects music data for performance using the operation unit 15 of the controller 1. The music data for performance is data (standard MIDI) prepared in advance based on the MIDI standard and stored in the HDD 13 of the controller 1. An example of such music data is shown in FIG. 4. As shown in FIG. 4, the music data includes a plurality of performance parts, and includes pieces of identification information that identify respective ones of the performance parts, and pieces of performance information about the performance parts.

When music data for performance is selected by some user, the controller 1 assigns performance parts to respective ones of the performance terminals 2 connected thereto. Which performance part should be assigned to which performance terminal is designated beforehand in a table. FIG. 5 is a view showing an example of the performance part assignment table. As shown in FIG. 5, MIDI port 0 (performance terminal for facilitator) corresponds to performance part 1. The performance part 1 is assigned to, for example, the performance terminal 2A in FIG. 1. Each MIDI port represents a port number in the MIDI interface box 3. Each performance terminal 2 is identified by the MIDI port to which it is connected. MIDI port 1 (piano 1) corresponds to performance part 2, which is assigned to, for example, the performance terminal 2B in FIG. 1. Ditto for the others. In this manner, the performance parts are automatically assigned to respective ones of the performance terminals 2. The performance part assignment table is registered beforehand in the HDD 13 of the controller 1 by the facilitator. Alternatively, the facilitator can make a manual selection using the operation unit 15 of the controller 1.

If the performance terminals 2 are connected to USB ports, the performance terminals 2 may be identified by USB port numbers.

A performance-start standby instruction is input by the facilitator via the operation unit 15 of the controller 1 after the music data for performance is selected by the facilitator and the performance parts are assigned by the controller 1 to respective ones of the performance terminals 2. The term "performance-start standby" does not indicate that music sound is actually produced, but indicates that the controller 1 reads out the music data for performance from the HDD 13 to the RAM 14 to thereby prepare for performance operation.

When the performance-start standby instruction is input to the operation unit 15 and the preparation for performance is completed by the controller 1, the performance terminals 2 are made ready for performance. With the present ensemble system, performance operations are implemented by a plurality of users in time with the facilitator's (ensemble leader's) performance. Since the users do not conduct performances in time with an exemplar performance (mechanic demonstrative performance), but in time with the facilitator's performance (human performance), they can have a sense of actually participating in an ensemble performance.

The following is an explanation of operations of the ensemble system during an ensemble performance. When the operator unit (keyboard) 23 of any of the performance terminals 2 is depressed by the user with a finger, the controller 22 transmits a Note On message to the controller 1 according to the intensity of key depression. The Note On message contains information representing the key depression intensity (Velocity), etc. When the keyboard 23 is released (the finger is lifted), the controller 22 transmits a Note Off message to the controller 1. Based on the Note On and Note Off messages received from the performance terminal 2, the controller 1 determines the pitch, length, etc. of each sound in the music data for performance of a predetermined length (e.g., for one beat) among the performance part assigned to the performance terminal 2, and transmits music data for performance having the determined pitch, length, etc. to the performance terminal 2, as sounding instruction data. The sounding instruction data includes sounding timing, length, intensity, tone color, effect, pitch change (pitch bend), tempo, and so on.

Based on a time period from when the Note On message has been received to when the Note Off message has been received, the controller 1 determines the sounding instruction data. Specifically, when the Note On message is input, the controller 1 reads out the corresponding performance part of the predetermined length (e.g., for one beat) among the music data for performance, and determines the sounding timing, tone color, effect, pitch change, etc. Further, the controller 1 determines the sounding intensity in accordance with the Velocity information in the Note On message. The performance information in the music data for performance contains information indicating the sound volume, but the sounding intensity is determined by multiplying the sound volume by the Velocity information. Specifically, although the music data for performance already includes sound volume information taking account of a volume representation (sound dynamics) for the music, a dynamics representation that varies depending on the user's key depression intensity is added, whereby the sounding intensity is determined.

When the Note Off message is input, the controller 1 times a time period from the reception of the Note On message to the reception of the Note Off message. Music sound sounded first is continued to be produced until the Note Off message is input. When the Note Off message is input, the tempo in the concerned beats and the length of each music sound are determined, and the next music sound is sounded.

Although the tempo may simply be determined based on the time period from the Note On to the Note Off (referred to as the Gate Time), the tempo can be determined as follows. The moving average of the Gate Time is calculated for a plurality of key depressions (immediately preceding key depressions) and weighted by time. The weight is the heaviest on the last key depression. The earlier the key depression is, the lighter the weight thereon is. By determining the tempo in this manner, a sudden tempo change can be prevented, even if one key depression causes a significant change in the Gate Time. Therefore, the tempo can smoothly be changed according to the flow of the music, without causing uncomfortable feeling.

In the performance terminal 2, the controller 22 receives the sounding instruction data determined as described above by the controller 1, and instructs the tone generator 24 to generate a sound waveform. The tone generator 24 generates a sound waveform and reproduces music sounds from the speaker 25. The above described processing is repeated every time each user depresses the keyboard 23. Thus, music performance can be made by depressing the keyboard 23, for example, on every beat.

As described above, the music sound sounded first is continued to be produced until a Note Off message is input. Therefore, the same music sound is kept produced until the user lifts his finger from the keyboard 23, whereby a sustained-sound representation (fermata) can be realized in the ensemble system.

It is also possible to realize the following performance representation by determining the tempo, as described above, based on the moving average of the Gate Time. For example, when a key depression is performed shortly on the keyboard 23, the length of each sound for the corresponding beats is made short, whereas when the keyboard 23 is depressed for a long duration, the length of each sound for the corresponding beats is made long. As a result, the performance representation of crisp sounds (staccato) without a significant change in the tempo can be realized, and the performance representation of sustained sounds (tenuto) without a significant change in the tempo can also be realized.

In this embodiment, the Note On and Note Off messages are transmitted to the controller 1 irrespective of which keyboard 23 of the performance terminals 2A to 2F is depressed. Alternatively, the keyboards 23 may be divided into those that enable the staccato and tenuto and those that do not. The controller 1 may change the length of sound while maintaining the tempo only when the Note On and Note Off messages are input from specific keyboards (e.g., E3).

Figure 6:
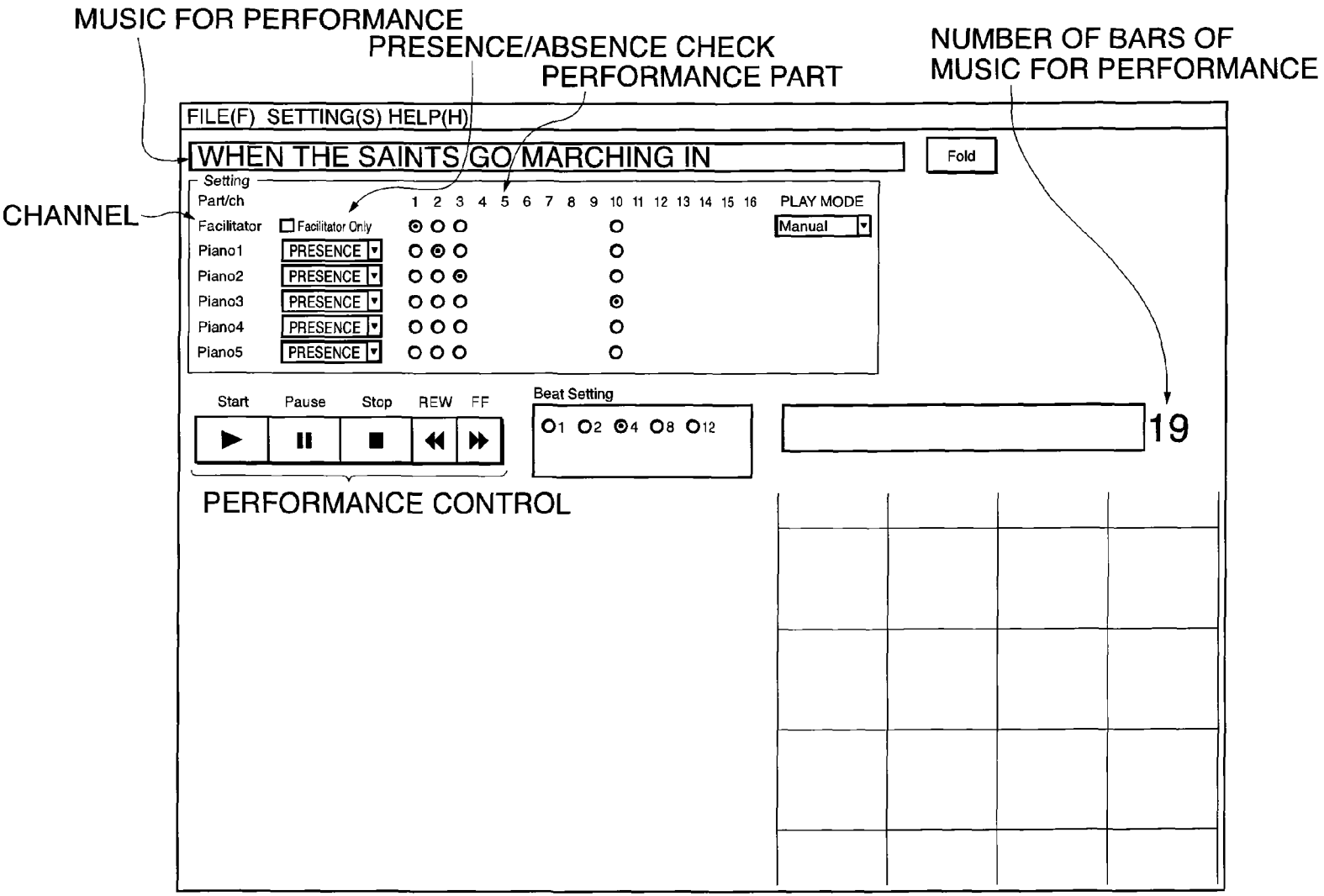
FIG. 6 is a view showing a main operation window.
Figure 7:
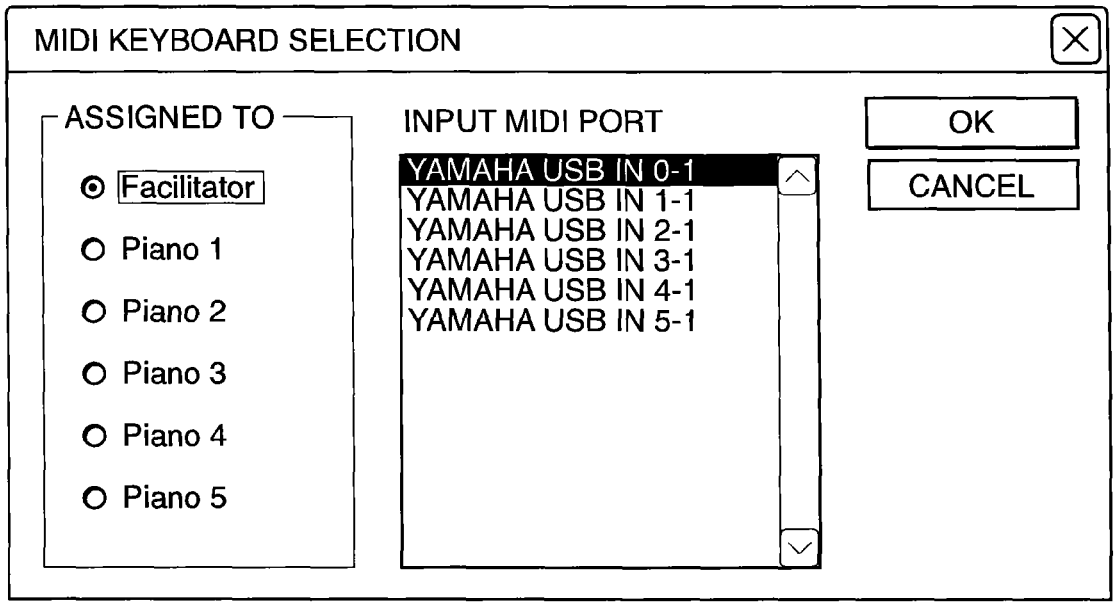
FIG. 7 is a view showing a MIDI port selection window.

Next, an explanation will be given of a user interface shown on the display unit 16. Referring to FIG. 6, a main operation window is displayed on the display unit 16. In a text field in an upper part of this window, the name of music data for being performed, which is selected by the user, is shown. In a "Setting" field, the performance terminals (Facilitator and Pianos 1 to 5) are indicated. For each of the performance terminals, a pull-down menu for selection of presence/absence and radio buttons for performance part assignment are shown. The performance terminals (Facilitator and Piano 1 to 5) are associated with MIDI ports of the MIDI interface box 3. It should be noted that, as shown in FIG. 7, the facilitator can manually select MIDI ports associated with the performance terminals (Facilitator and Pianos 1 to 5).

The selective input to the presence/absence pull-down menus is performed by the facilitator according to the presence or absence of the educands. The radio buttons are shown only for performance terminals to which performance parts of the music data for performance are respectively assigned.

In the example shown in FIG. 6, performance parts 1, 2, 3, and 10 are set for the selected music data for performance. When this music data for performance is selected, the performance terminals "Facilitator", "Piano 1", "Piano 2" and "Piano 3" are automatically assigned to respective ones of the performance parts 1, 2, 3, and 10. In FIG. 6, the selected music data for performance includes only four performance parts, and therefore, these performance parts are assigned only to the performance terminals "Facilitator" and "Pianos 1 to 3". On the other hand, in the case, for example, that the music data for performance includes six performance parts, these performance parts are respectively assigned to the performance terminals "Facilitator" and "Pianos 1 to 5". In the case that there are performance parts greater in number than the MIDI ports (performance terminals), more than one performance parts are assigned to the performance terminal "Facilitator". The user (facilitator) operating the controller 1 can manually select, by the radio button selection, respective performance parts for desired performance terminals. When a checkbox "Facilitator Only" is selected, all the performance parts are assigned to the performance terminal "Facilitator". No radio button is displayed for performance terminals 2 set as "absent" on the pull-down menus, so that no performance part is assigned to these performance terminals 2.

In the case that the performance part assignment is automatically implemented based on the table shown in FIG. 5, if there is a performance terminal for which the "absence" is selected on the presence/absence pull-down menu, a performance part scheduled to be assigned to the absent performance terminal is assigned to the performance terminal "Facilitator". In that case, the performance part for the "absent" performance terminal may be assigned to another performance terminal, instead of a performance part scheduled to be assigned to the other performance terminal and close in tone color or role to the performance part for the absent performance terminal (for example, the part scheduled to be assigned to the absent terminal is a drums part, and the part scheduled to be assigned to the other terminal is a base part, string instrument part, or the like). The relation between interrelated performance parts may be specified in advance in the table.

Figure 8:
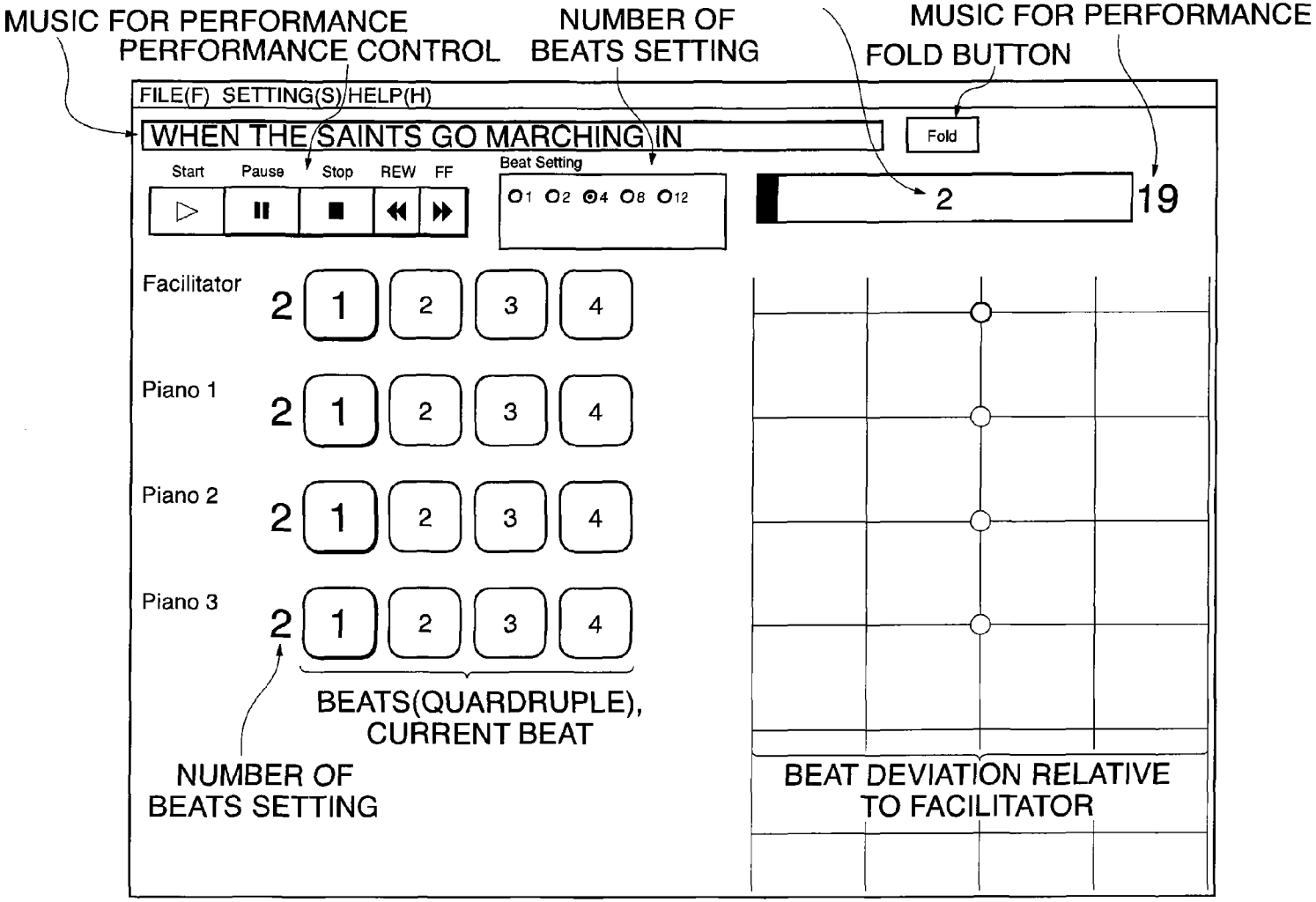
FIG. 8 is a view showing an ensemble window.
Figure 9A:
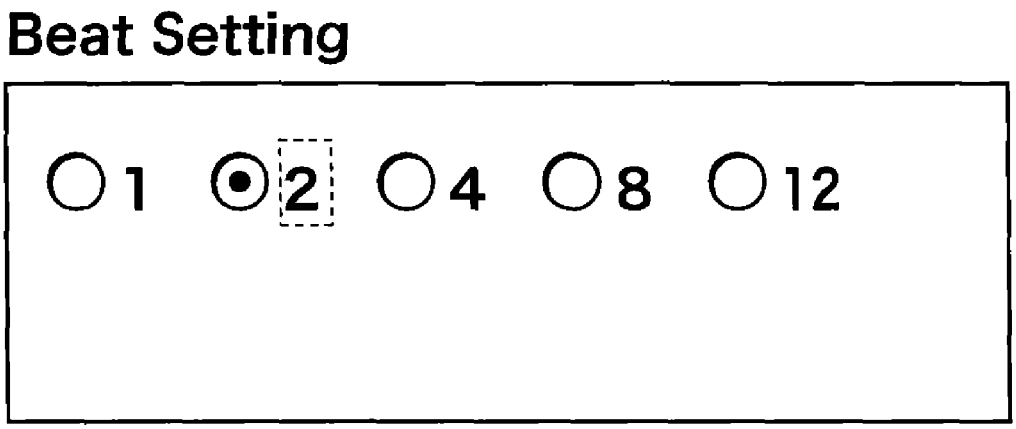
FIG. 9A is a view showing the setting of the number of beats.

When a Start button among performance control buttons displayed on the left side of the middle of the window is depressed after execution of the performance part assignment, performance-start standby is achieved, and an ensemble window shown in FIG. 8 is displayed on the display unit 16. Also in this window, the name of the selected music data for performance is displayed in an upper text field. On the upper right side of the window, there are displayed the number of bars included in the selected music data for performance and the current bar number at which the performance is currently performed. In a number of beats field (Beat Setting) displayed on an upper part of the middle of the window, radio buttons for setting the number of beats in one bar are shown. In FIG. 8, the number of beats is set to four, and the music data is performed at four-four time (four beats per bar). In that case, a key depression will be made on every beat. When a two-beat button is selected for the music being performed as shown in FIG. 9A, a key depression will be made on every other beat, and the first and third beats will be the key depression timing. In that case, in response to the transmission of Note On and Note Off messages from the performance terminal 2, the controller 1 returns sounding instruction data of the length of two beats. That is, the performance will be performed for the length of two beats in response to one key depression.

Figure 9B:
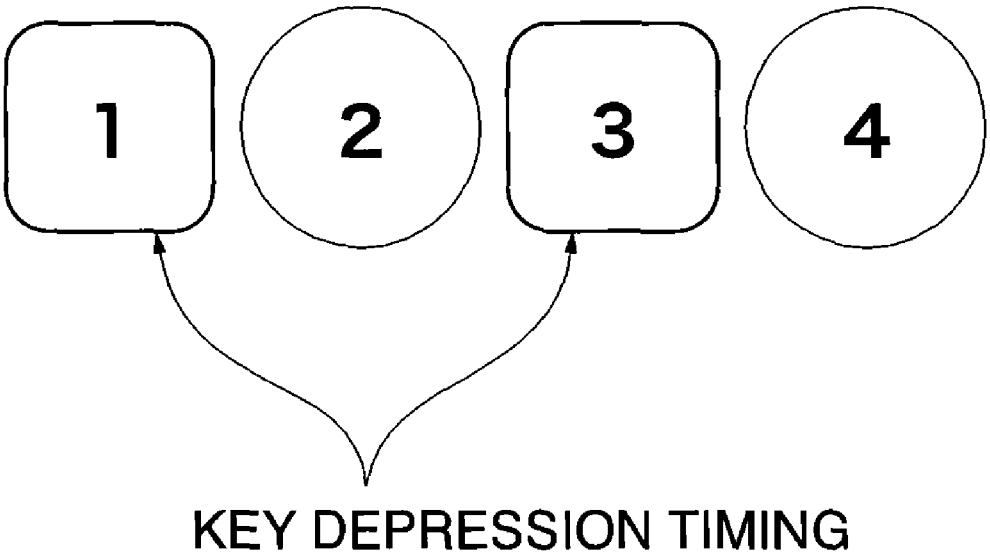
FIG. 9B is a view showing an example of icon representations of beats (first and third beats) corresponding to key depression timing and beats (second and fourth beats) not corresponding to key depression timing.

Referring to FIG. 8, the current bar number, the number of beats in the bar (the number of times the key depression should be made in the bar), and the current beat (current key depression timing) for each of the performance terminals (Facilitator, Piano 1, Piano 2, and Piano 3) are displayed on the left side of the middle of the ensemble window. As shown in FIG. 8, the number of times the key depression should be made is represented by rectangular icons each having a numeral therein, and the current beat is represented by a three-dimensional rectangular icon or a bold icon. The way of representation is not limited to using these icons described in this example, but differently shaped icons may be used. As shown in FIG. 9B, the beats deviated from key depression timing (i.e., the second and fourth beats) are each indicated by a differently shaped icon such as a circular icon having a numeral therein.

Figure 10:
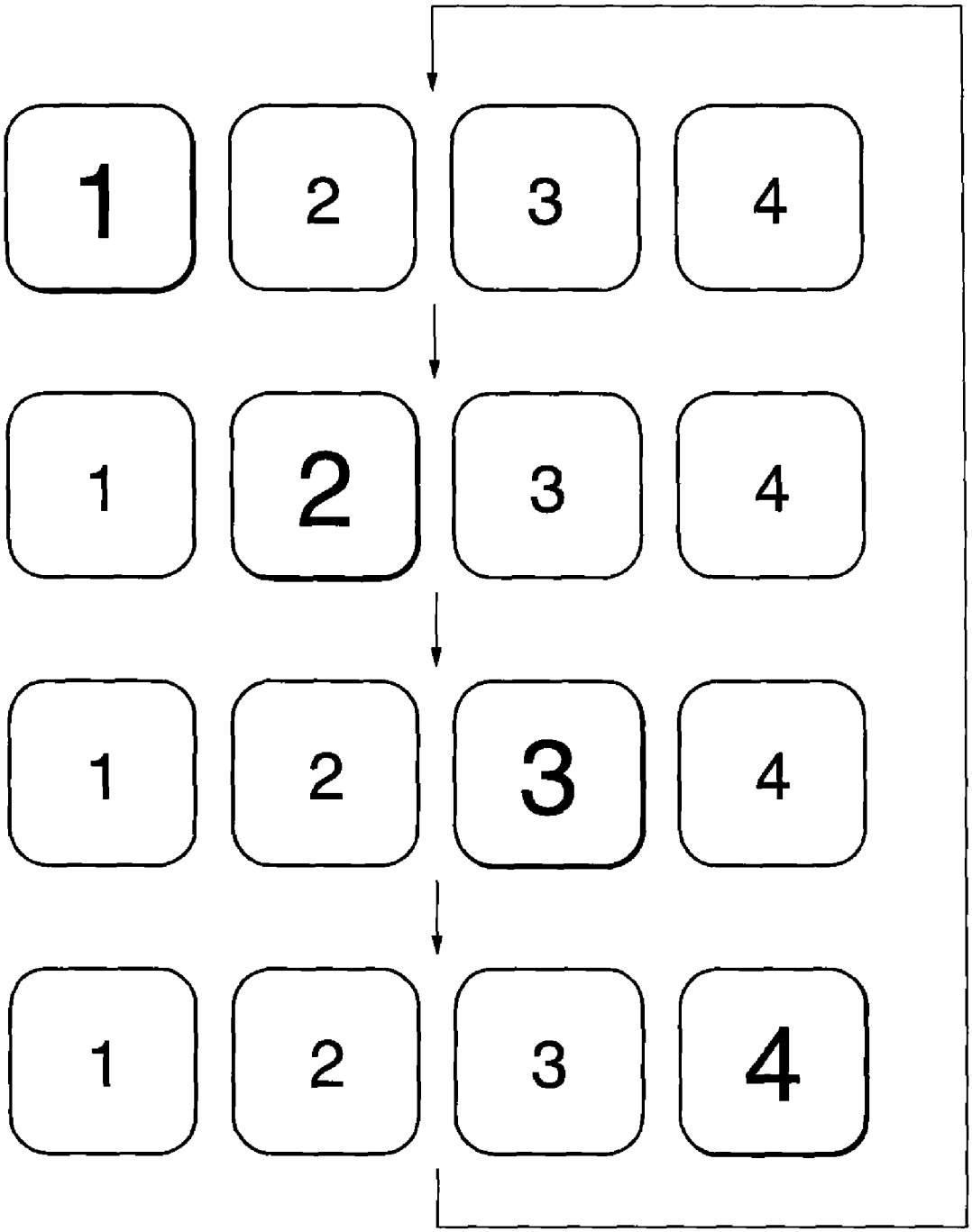
FIG. 10 is a view showing a shift of current beat.

Upon each key depression by the user, the current beat shifts one by one as shown in FIG. 10. Specifically, the beat represented by the three-dimensional rectangular icon or the bold icon shifts between the first, second, third, and fourth beats in this order on every key depression. In this example, the music data of four-four time is used for performance, and therefore, subsequently to the key depression on the fourth beat, the current beat is returned to the first beat, whereby the music data is advanced by one bar.

Referring to FIG. 8, a field for indicating a beat deviation relative to the beat of the performance terminal "Facilitator" is displayed on the right side of the middle of the window. In this field, a plurality of (for example, five) vertical lines are shown, and lateral lines are shown such as to correspond to respective ones of the performance terminals. In addition, there are shown circular marks respectively corresponding to these performance terminals. Each circular mark indicates a deviation relative to the performance terminal "Facilitator".

Figure 11:
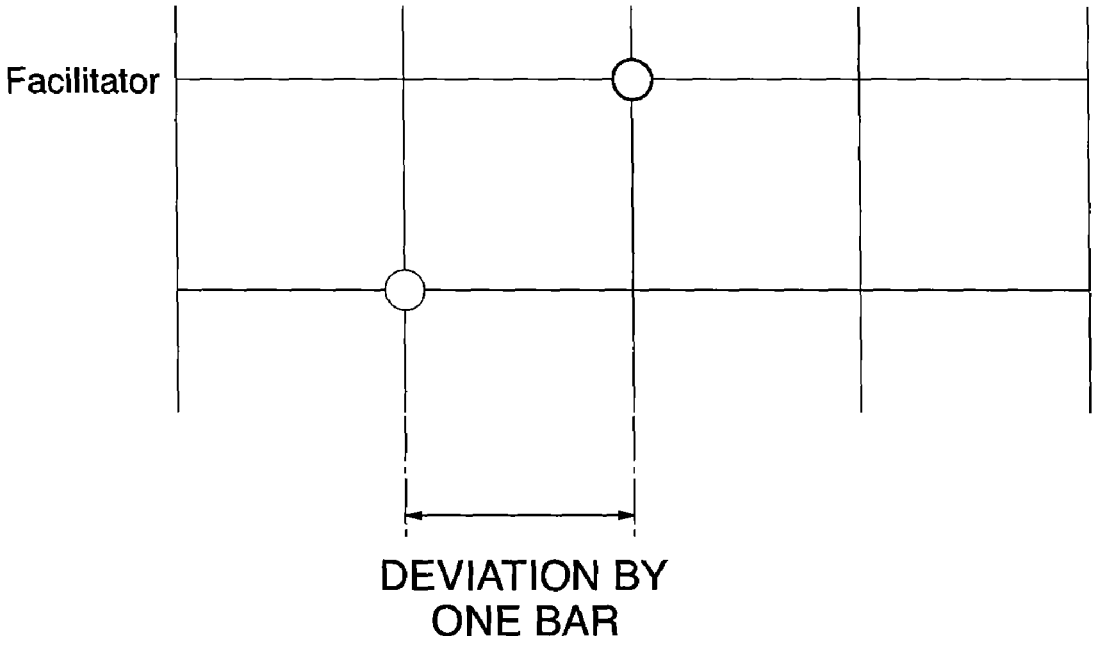
FIG. 11 is a view for explaining a beat deviation relative to a performance terminal "Facilitator"

FIG. 11 is a view for explaining a beat deviation relative to the performance terminal "Facilitator". As shown in FIG. 10, the circular mark corresponding to the performance terminal "Facilitator" is fixedly shown on the center line among the vertical lines, and each of the circular marks respectively corresponding to user's performance terminals (for example, the circular mark corresponding to "Piano 1") is moved to the left and the right according to the beat deviation relative to the performance terminal "Facilitator". For example, when the key depression is lag behind the key depression on the performance terminal "Facilitator" by one bar (four beats in this example), the circular mark is moved leftward by one vertical line as shown in FIG. 10. If there is a delay of one-half bar (two beats), the circular mark is moved leftward from the center vertical line by a distance equal to half an interline distance. On the other hand, if the key depression leads the key depression on the performance terminal "Facilitator", the circular mark is moved rightward. In FIG. 11, there are displayed two lines with respect to the center line on each side, left and right, and therefore, a beat deviation of up to two bars can be displayed. If there occurs a beat deviation of more than two bars, the icon is changed (into, for example, a rectangular icon) at the left or right end of the line. As a result, each user can easily recognize a deviation of performance (beat) from that of the facilitator. Although the shift of one line represents a deviation of one bar in the above example, the shift of one line may represent a deviation of one-half bar or two bars, for example.

It should be noted that a reference performance terminal is not limited to the performance terminal "Facilitator". An amount of beat deviation may be displayed with reference to any of the performance terminals 2.

The field for indicating the beat deviation relative to the performance terminal "Facilitator" is not limited to the above described example where it is displayed on the display unit 16 of the controller 1, but can be displayed on a display unit (not shown) for performance terminal, which is provided in each of the performance terminals 2.

As described above, each user can implement the performance by performing simple operations such as depressing the keyboard with a finger, and an ensemble performance can be carried out by the users, while enjoying themselves, by making operations in such a way as to reduce a deviation of performance (beat) displayed on the display unit 16 from that of the performance terminal "Facilitator".

Figures 12A, 12B:
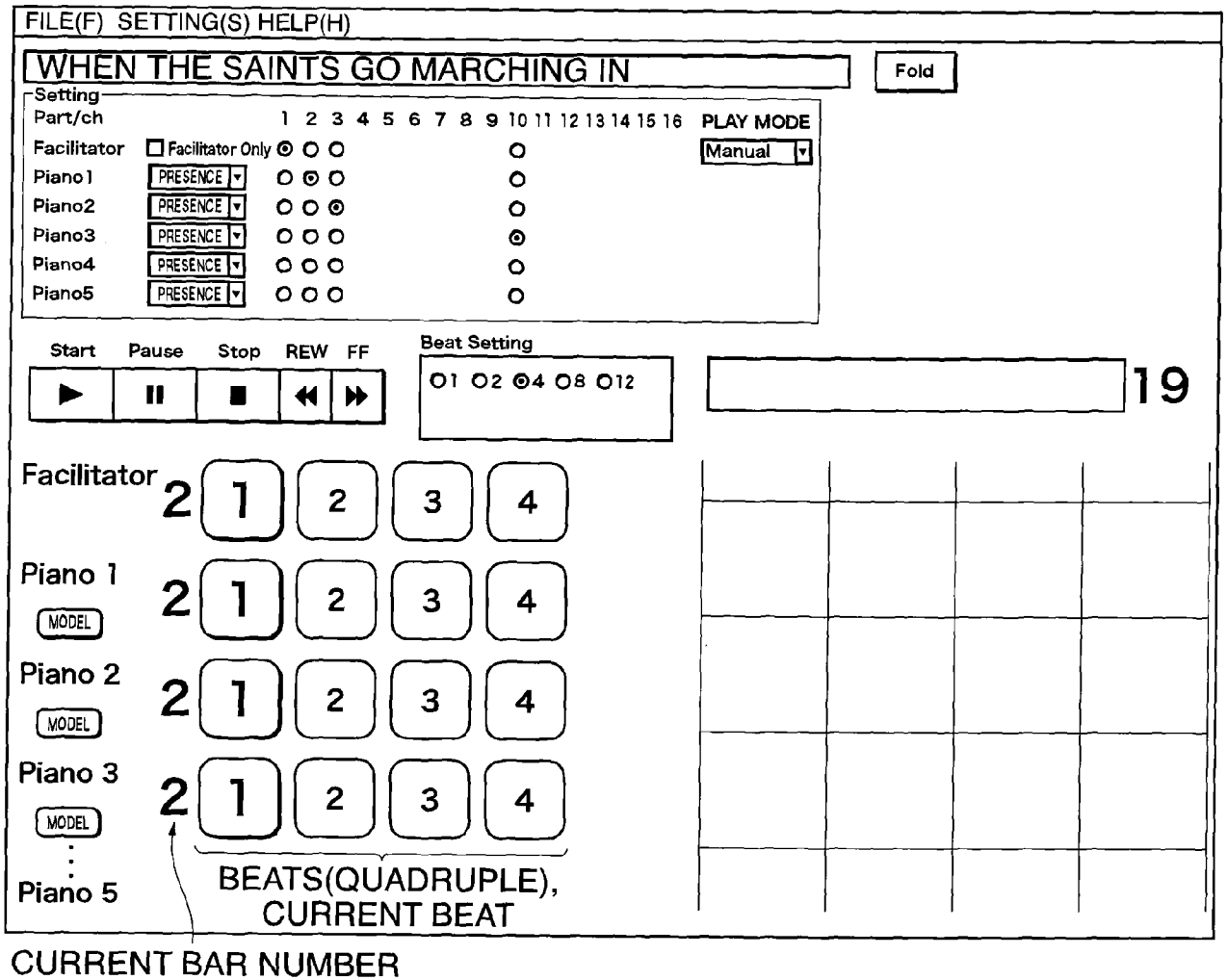
FIG. 12A is a view for explaining a model performance mode.
FIG. 12B is a part of a screen on which a performance terminal for performing a model performance is selected.

The following operation can be carried out as a modification by the ensemble system. FIG. 12A is a view for explaining a model performance mode. As shown in FIG. 12A, "model" icons are displayed on some part (for example, on a left part) of the main operation window in FIG. 6. When any of the "model" icons is depressed by the facilitator, an ordinary mode is changed over to the model performance mode. FIG. 12B is a part of a screen on which a performance terminal for performing a model performance is selected. As shown in FIG. 12B, in the model performance mode, radio buttons for performance terminals 2 other than that for the facilitator are displayed. The facilitator selects the radio button corresponding to one of the performance terminals (Piano 1 to Piano 5) with which the facilitator performs a model performance. In the model performance mode, a performance operation on the selected performance terminal 2 is carried out at the performance terminal "Facilitator", and music sound is reproduced from the selected performance terminal 2 in accordance with the operation at the performance terminal "Facilitator". For example, in a case where the Piano 1 is selected as shown in FIG. 12B, when the keyboard of the performance terminal "Facilitator" is depressed, the controller 1 transmits sounding data to the performance terminal "Piano 1" in accordance with a note message input to the controller. The sounding data to be transmitted is the performance part assigned to the performance terminal "Piano 1". In the performance terminal "Piano 1", music sound is sounded based on the received sounding data. As a result, the model performance by the facilitator can be heard by each user by his/her performance terminal at hand. In the above example, the case where a single performance terminal is selected using a radio button and the model performance is carried out. Alternatively, the model performance can be carried out after a plurality of performance terminals are selected simultaneously. All the performance terminals can be selected.

Figure 13:
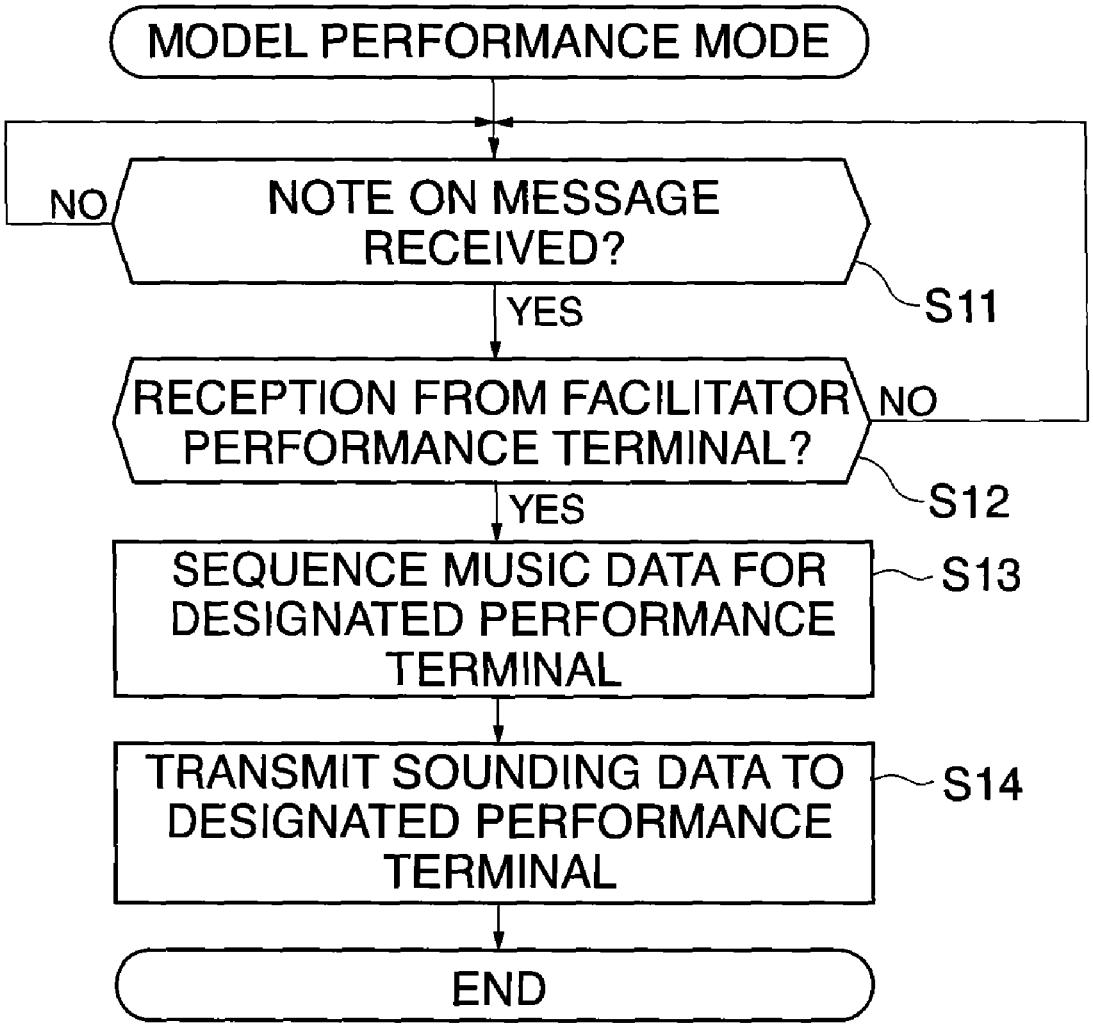
FIG. 13 is a flowchart showing operation of the controller in the model performance mode.

The operation of the ensemble system in the model performance mode is described in detail below. FIG. 13 is a flowchart showing the operation of the controller 1 in the model performance mode. When any of the "model" icons is depressed by the facilitator, the start of the operation is triggered.

First, it is determined whether or not a Note On message is received (s11). This determination is repeated until a Note On message is received. If a Note On message is received, whether or not the Note On message has been transmitted from the performance terminal for use by the facilitator is determined (s12). If the received Note On message has not been transmitted from the performance terminal for the facilitator, the flow is repeated from the determination on reception (s12 to s11). On the other hand, if the received Note On message has been transmitted from the performance terminal for the facilitator, music data for the performance part assigned to a designated performance terminal is sequenced (the tone pitch and length of each sound, etc. are determined) (s13). As described above, at least one performance terminal to be designated is selected by the facilitator. It is assumed that the Piano 1 is selected as the designated performance terminal in the initial setting when any of the "model" icons is depressed by the facilitator. Alternatively, a performance terminal corresponding to a "model" icon in FIG. 12A which has been depressed can be selected as the designated performance terminal. Subsequently, sounding data is transmitted to the designated performance terminal (s14).

As describe above, with the ensemble system of this embodiment, performance parts are automatically assigned by simply specifying attendance (presence) and nonattendance (absence) of performance terminals, and therefore, the performance parts can easily and flexibly be assigned to the facilitator and the participants. Moreover, since performance parts for respective performance terminals can manually be changed, the performance parts can be played by performance terminals different from those at the initial setting.

INDUSTRIAL APPLICABILITY

With this invention, since automatic assignment of performance parts is achieved by only specifying attendance (presence) and nonattendance (absence) of performance terminals, easy and flexible assignment of performance parts can be carried out between the facilitator and the participants. Since performance parts for performance terminals can manually be changed, the performance parts can be played by performance terminals different from those at the initial setting, and a model can be given by the performance terminal for the facilitator.

The invention claimed is:

1. An ensemble system comprising:

a plurality of performance terminals each having at least one performance operator unit for performance operation by a user;

at least one tone generator; and a controller connected to the plurality of performance terminals and the at least one tone generator to control each of the performance terminals, wherein the controller includes:

a storage device that store pieces of music data for performance, each piece including a plurality of performance parts, and an assignment list including identification information indicating which performance part should be assigned to which performance terminal;

an operation unit that designates at least one performance terminal participating in an ensemble and at least one performance terminal not participating in the ensemble, and selects music data for performance to be played in the ensemble;

a performance part assignment unit that assigns the performance parts to respective performance terminals in accordance with the assignment list when music data for performance is selected by the operation unit, and changes assignment of at least one performance part to be assigned to one of the performance terminals, from the at least one performance terminal not participating in the ensemble to another of the performance terminals participating in the ensemble; and a performance control unit that reads out the performance part assigned to each of the performance terminals in accordance with a way in which the performance operator unit of each of the performance terminals is operated, and outputs performance data representing the performance parts performed by each of the users to the tone generator.

2. The ensemble system according to claim 1, wherein the controller includes:

a mode changeover unit that changes an ordinary performance mode over to a model performance mode; and a selection unit that selects, in the model performance mode, at least one performance terminal for executing a model performance from among the plurality of performance terminals, wherein a guiding performance terminal carries out a guidance performance operation on the at least one performance terminal selected by the selection unit, and wherein music sound is reproduced by the selected at least one performance terminal in accordance with the performance operation carried out at the guiding performance terminal.

3. The ensemble system according to claim 1, wherein:

the tone generator is built in to each of the plurality of performance terminals, and the performance control unit outputs data on the performance part read out to the tone generator built in to the performance terminal to which that performance part is assigned.

4. The ensemble system according to claim 1, wherein the performance part assignment unit changes the performance part assignment to each of the performance terminals in accordance with a performance part assignment changing instruction from the operation unit.

5. The ensemble system according to claim 1, wherein the performance part assignment unit, in a case where the performance terminals indicated in the assignment list include a performance terminal not participating in the ensemble, assigns to a guiding performance terminal the performance part having been assigned to the performance terminal not participating in the ensemble.

6. The ensemble system according to claim 1, wherein:

the storage device further stores a table in which interrelated performance parts are specified as one group, and the performance part assignment unit, in a case where the performance terminals indicated in the assignment list include a performance terminal not participating in the ensemble, based on the table, assigns the performance part having been assigned to the performance terminal not participating in the ensemble to another performance terminal to which another performance part belonging to a same group has been assigned.

* * * * *